US006092518A

United States Patent [19]

Dané

[11] Patent Number: 6,092,518

[45] Date of Patent: Jul. 25, 2000

[54] COOKING APPLIANCE, GAS BURNER FOR THIS APPLIANCE AND METHOD FOR MOUNTING SUCH A GAS BURNER ON SUCH APPLIANCE

[75] Inventor: Bernard Dané, Montbazon, France

[73] Assignee: Sourdillon, Veigne, France

[21] Appl. No.: 09/284,220

[22] PCT Filed: Oct. 9, 1996

[86] PCT No.: PCT/FR96/01572

§ 371 Date: Apr. 9, 1999

§ 102(e) Date: Apr. 9, 1999

[87] PCT Pub. No.: WO98/15780

PCT Pub. Date: Apr. 16, 1998

[51] Int. Cl.[7] ..... F24C 15/10; F24C 3/00

[52] U.S. Cl. ..... 126/214 D; 126/41 R; 126/42; 126/39 E; 239/461; 431/350; 431/354

[58] Field of Search ..... 126/214 D, 220, 126/39 R, 41 R, 39 B, 42, 39 E; 239/399, 402, 402.5, 461, 463, 466; 431/350, 354, 8, 9

[56] References Cited

U.S. PATENT DOCUMENTS

| | | | |
|---|---|---|---|
| 1,984,708 | 12/1934 | Surges | 126/214 D |
| 2,024,510 | 12/1935 | Crisenberry | 126/214 D |
| 2,096,765 | 10/1937 | Saha | 239/400 |
| 2,276,131 | 3/1942 | Wiant | 239/463 |
| 2,914,257 | 11/1959 | Wiant | 239/461 |
| 5,236,350 | 8/1993 | Cummings, III et al. | 431/354 |
| 5,405,263 | 4/1995 | Gerdes et al. | 126/39 K |
| 5,649,822 | 7/1997 | Gertlet et al. | 431/354 |
| 5,901,695 | 5/1999 | Deptolla | 126/39 K |

FOREIGN PATENT DOCUMENTS

| | | |
|---|---|---|
| 0 554 511 | 8/1993 | European Pat. Off. . |
| 1 360 192 | 8/1993 | France . |

*Primary Examiner*—Ira S. Lazarus
*Assistant Examiner*—Josiah C. Cocks
*Attorney, Agent, or Firm*—Greer, Burns & Crain, Ltd.

[57] ABSTRACT

The invention concerns a cooking appliance comprising devices for cooking of which at least one burner with spiralling flames. The ducts for delivering the fuel mix towards the external part of the burner with spiralling flames are inclined with respect to a peripheral line on which the flame outlets are distributed. The invention is useful for high-powered gas burners for cooking food.

21 Claims, 3 Drawing Sheets

COOKING APPLIANCE, GAS BURNER FOR THIS APPLIANCE AND METHOD FOR MOUNTING SUCH A GAS BURNER ON SUCH APPLIANCE

BACKGROUND OF THE INVENTION

The present invention relates to a cooking appliance, such as a cooker or a built-in hob unit.

It also relates to a gas burner for such a cooking appliance and to a method for mounting such a burner on such appliance.

Cooking appliances are known which comprise several cooking devices distributed over a cooking hob, for example gas burners and/or electric hotplates.

Conventional gas burners comprise, in particular, a gas injector, generally placed below the cooking hob surface, and a burner head, which emerges above the cooking hob surface. The gas is conveyed in a convergent-divergent system, of the venturi tube type which can, in particular, be a horizontal venturi or a radial venturi.

These known burners can also carry accessories, such as for example a spark ignition device, or a safety device such as a thermocouple designed to control a cut off of the gas supply when the burner flame is extinguished.

The head of the burner conventionally comprises several elements, including a burner body and a cover.

A flame distributor ring forms part of the head of the burner. It is, depending on the case, integral with the burner body or with the cover, or sometimes with an intermediate element which is positioned between the body and the cover.

The burners of the prior art have flame outlet orifices distributed along a peripheral line of the flame distributor ring, said orifices constituting the outer end of ducts formed in the ring for the delivery of the fuel mixture.

The delivery ducts of the known burners are directed radially outwardly, starting from a central point of the burner, and emerge on the periphery of the flame distributor ring. When the peripheral line of the ring is circular, the longitudinal direction of the ducts is normal to said peripheral line.

In operation, these burners supply flames which radiate radially outside of the burner, the points of the flames are inscribed in a perimeter which is substantially concentric with the perimeter defined by the peripheral line of the flame distributor ring.

If it is desired to increase the power of the burner, the flow rate of gas injected into the burner is increased. This necessitates, in order for the combustion to take place suitably, increasing the diameter of the burner head in order to increase the number of flames, and/or increasing the length of the said flames.

However, such burners would no longer pass the fabric ignition test, which consists in placing pieces of fabric near to a vessel of standardized dimensions placed above an ignited burner, in order to simulate the sleeves of the clothing of a user placed facing the front of the cooking appliance.

Because at powers greater than the maximum powers achieved at present by conventional burners, the latter produce flames which protrude from under the bottom of standardized vessels, they present a risk of igniting fabrics.

The risk becomes even greater as the burner becomes closer to the user, that is to say if the burner is positioned at the front of the appliance.

A first object of the invention is to propose a cooking appliance comprising at least one gas burner whose maximum power is sufficiently high to meet the current needs of users, while complying with the conditions imposed by the fabric ignition safety standards.

SUMMARY OF THE INVENTION

According to the invention, the cooking appliance, comprising at least one gas burner, said gas burner comprising in particular a gas injector and a burner head, and having flame outlet orifices distributed around a peripheral line of a flame distributor ring forming part of the burner head, said orifices constituting the outside end of fuel mixture delivery ducts formed in the ring, is characterised in that:

- in orthogonal projection in a middle plane perpendicular to the axis of the burner, the longitudinal directions of the ducts, at their intersection with the peripheral line, all exhibit an inclination to the same side with respect to this line, such that the burner is a burner with flames spiralling about the axis of the burner,
- the said burner with spiralling flames is positioned at the font of the appliance.

Thus the flames formed by the said burner of the cooking appliance, spiral around the burner instead of radiating radially, which makes it possible to increase the power of the burner without increasing the perimeter within which the flame points are inscribed.

With this arrangement, the distance between the axes of the flames is smaller than the distance between two successive ducts measured along the peripheral line. It could therefore be feared that the flames would interfere with each other, which would be detrimental to combustion or that, in order to avoid this, that the diameter of the burner head would have to be increased greatly, which would lead to a similar increase in the space occupied by the flames, contrary to the sought objective. But, surprisingly, the invention escapes this dilemma: in particular with radial venturi burners, the diameter of the present burners is relatively large and allows a certain inclination of the flames without the combustion becoming degraded.

According to the invention, the cooking appliance comprises several burners including a burner with spiralling flames, the most powerful burner is the said burner with spiralling flames.

Still according to the invention, the cooking appliance furthermore comprises at least one burner with substantially radial flames, of lower power.

The patent FR-A-1 360 192 (1963) already describes burners whose delivery ducts have an inclination with respect to the normal to the curve on which are disposed the flame outlet orifices. But the purpose of this prior art is different from that of the present invention: because of their great inclination, the main flames of the known burner are sufficiently close to each other for them to be maintained mutually without recourse to pilot flames.

For this purpose, the prior invention recommends an inclination as close as possible to 90°, which in practice is between 45° and 80°. This older technique (1963), because it produces interference between the main flames, does not take account of the present day requirements of environmental standards relating to the quality of combustion and the quantity of CO and NO expelled into the ambient air.

According to another aspect of the invention, the cooking appliance comprises gas burners which comply with the said standard requirements.

For this purpose, the burner with spiralling flames of a cooking appliance exhibits a maximum inclination of the flames which, taking account of the dimensions of the burner, does not penalize the aeration of the burner, that is to say the provision of additional air to optimize the combustion.

According to a third aspect of the invention, the method for mounting a gas burner with spiralling flames on a cooking hob designed for at least two cooking devices at the front and at least one at the rear, is characterized in that the burner with spiralling flames is placed at the front of the cooking hob and on a side such that the flames adjacent to the other cooking device located at the front of the cooking hob are inclined towards the rear of the cooking hob.

BRIEF DESCRIPTION OF THE DRAWINGS

Other features and advantages of the invention will furthermore appear in the following description. In the accompanying drawings, given as non-limitative examples.

DESCRIPTION OF THE PREFERRED EMBODIMENT

In order to clarify the description, it is convenient in the rest of this description for the left and/or right orientations and/or inclinations to be described when looking at the devices from above and from the center towards the outside.

FIGS. 1, 2, 9 and 10 illustrate cooking appliances equipped with four cooking devices.

Figure 1:
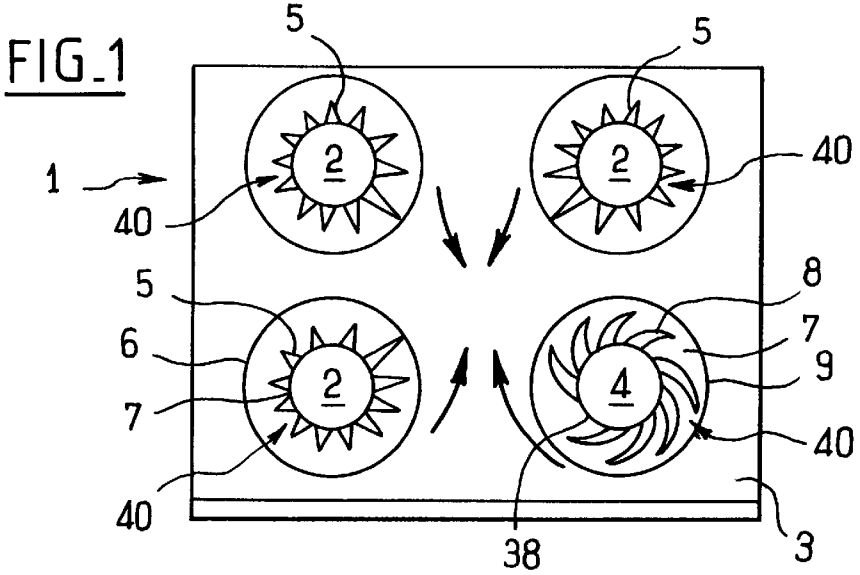
FIGS. 1 and 2 show a cooking appliance according to the invention in plan view and in front view respectively.

In FIG. 1 there is shown in plan view a cooking appliance 1 equipped with three conventional burners 2 and with one burner with spiralling flames 4.

The flames 5 of the conventional burners 2 radiate radially outwardly of the burner 2, and their points are inscribed within a perimeter 6 which is substantially concentric with the contour 7 of the burner.

The flames 8 of the burner with spiralling flames 4 wind around the latter, and their points are inscribed within a perimeter 9 which is substantially concentric with the contour 7 of the burner.

It is observed that the perimeter 9 has substantially the same dimensions as the perimeter 6, even though the burner with spiralling flames 4 is more powerful than the conventional burners 2.

Figure 2:
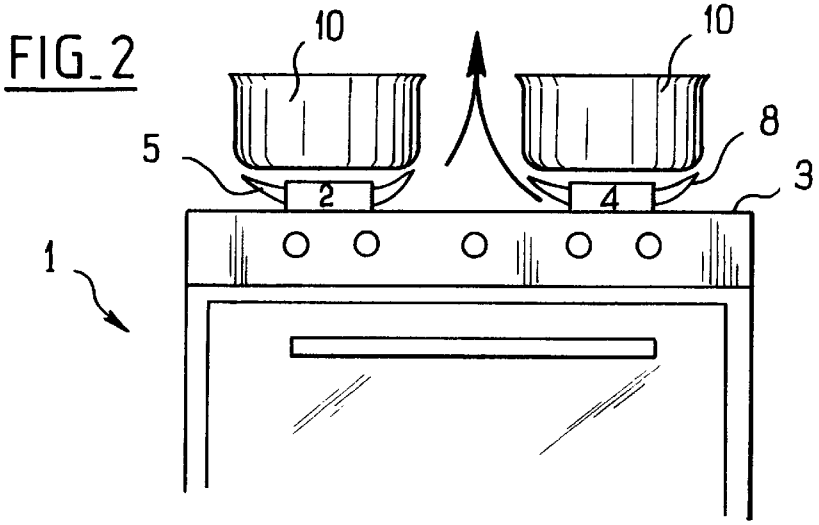

This is clearly confirmed in FIG. 2 which shows the same cooking appliance 1 in front view.

Standard vessels 10 are placed on the burners 2 and 4. According to fabric ignition tests, the flames 8 of the burner with spiralling flames 4 do not protrude from under the bottom of the vessel 10, even though this burner 4 is more powerful than the conventional burners 2.

In FIGS. 1 and 2, the arrows indicate the directions of air convection movements induced when the burners are in operation. These currents converge towards a rising column of hot air, starting from the center of the cooking hob 3. As the burner with spiralling flames 4 is more powerful than the burners with radial flames 2, it causes stronger convection movements than those caused by the burners with radial flames 2.

Figure 3:
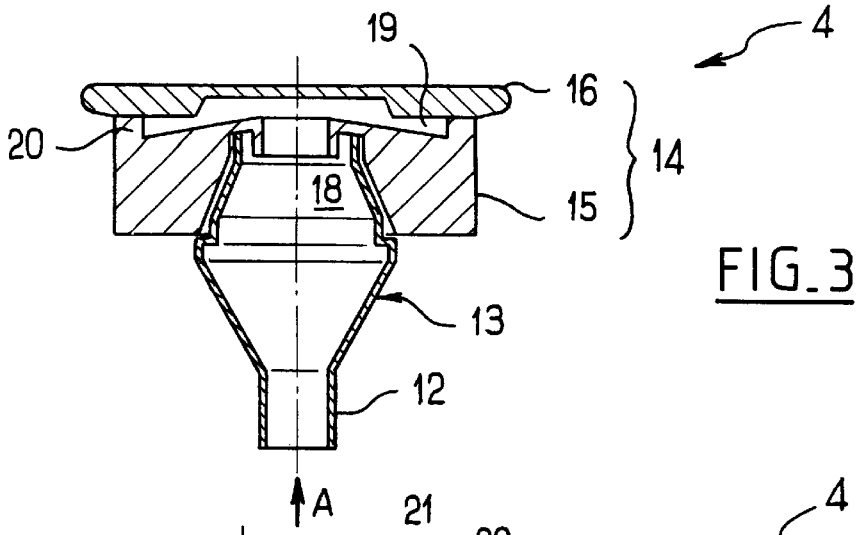
FIGS. 3 and 4 show the constituent elements of two gas burners in longitudinal cross-section.
Figure 4:
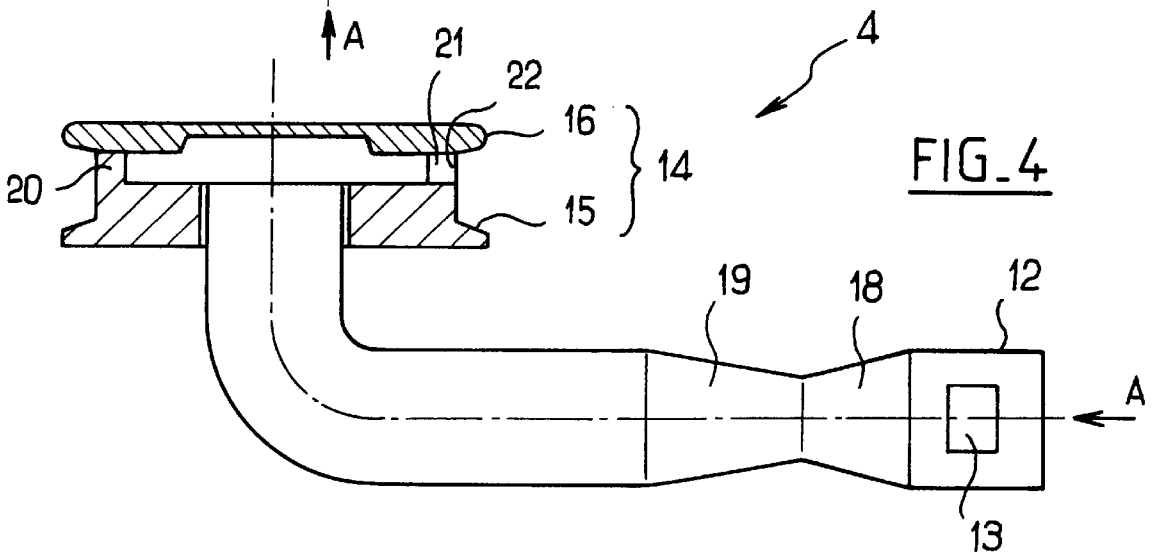
Figure 8:
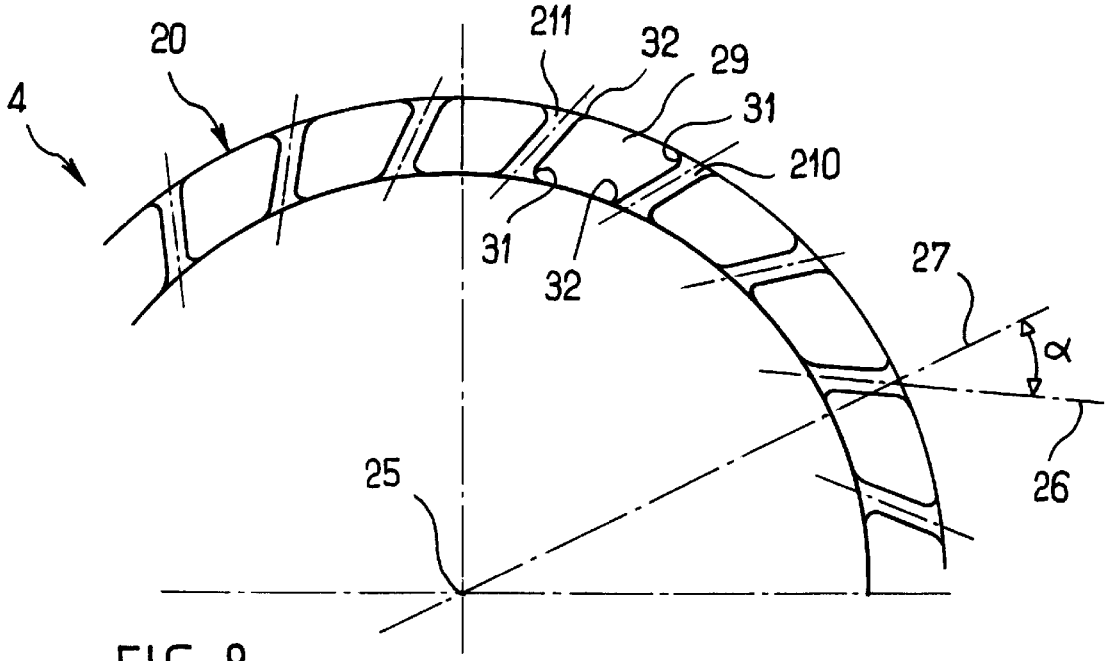
FIG. 8 shows the shape of the fuel mixture delivery ducts, seen from above.

In FIGS. 3 and 4, two structures of gas burners 4 according to the invention are shown.

The gas is injected into the pipe 12 of the burner 4 in the direction indicated by the arrow A. It is mixed with primary air which penetrates into the burner through openings 13 formed for this purpose in the wall of a mixing zone which is located downstream of the pipe 12.

From this chamber, the fuel mixture is conveyed into a space inside the burner head 14 formed, in the illustrated examples, from a burner body 15 surmounted by a cover 16 which between them define the said space.

The path of the mixture encounters a venturi system formed from a convergent section 18 followed by a divergent section 19. FIG. 3 illustrates the example of a burner with a radial venturi and FIG. 4 illustrates the example of a burner with a horizontal venturi. In the case of the radial venturi (FIG. 3), the divergent section 19 consists of the space formed between the body 15 and the cover 16.

In the illustrated examples, a flame distributor ring 20 is integral with the burner body 15. In the case of FIG. 3 (radial venturi), the ring 20 is located radially beyond the divergent section 19.

Ducts 21 are formed in the flame distributor ring 20 to deliver the mixture towards the outside of the burner. These ducts 21 emerge through flame outlet orifices 22 at the periphery of the flame distributor ring 20. At the outlet of ducts 21, the mixture of gas and primary air undergoes an aeration known as "secondary" and combustion producing the flames of the burner.

Figure 5:
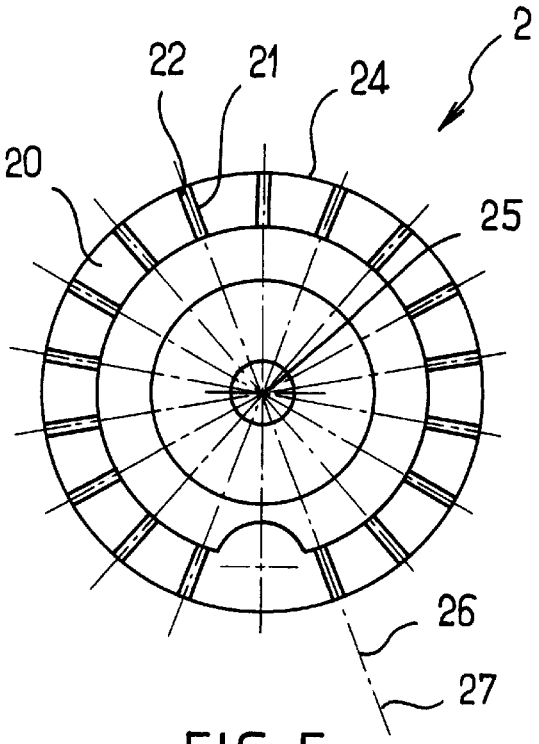
FIG. 5 shows the fuel mixture delivery ducts for a burner with radial flames, seen from above.

FIG. 5 shows, in a plan view, a conventional burner body 2 fitted with a flame distributor element 20 in which mixture delivery ducts 21 are formed.

Flame outlet orifices 22 distributed along the peripheral line 24 of the flame distributor ring 20 constitute the outer ends of the delivery ducts 21.

In projection in the plane of view which is perpendicular to the axis 25 of the burner, the longitudinal directions 26 of the ducts 21 are merged with the directions 27, normal to the peripheral line 24 and passing through the flame outlet orifices 22.

Figure 6:
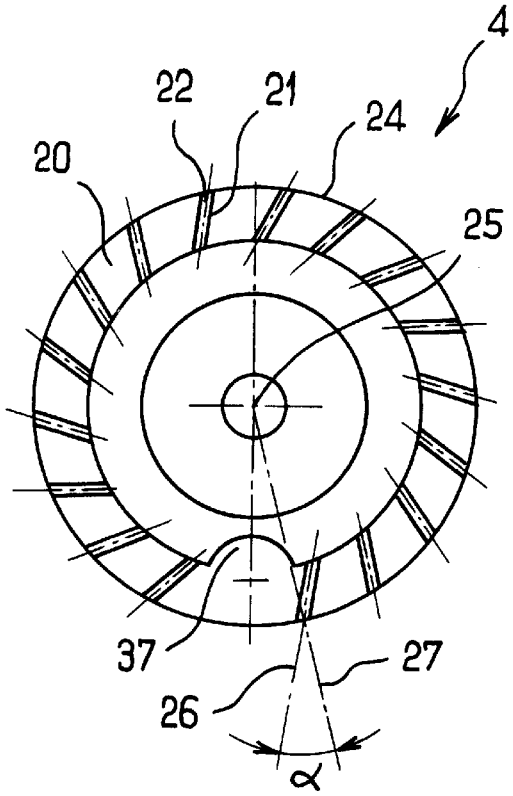
FIGS. 6 and 7 are views similar to that of FIG. 5, but relating to two embodiments of a gas burner according to the invention, which differ by the inclination of the ducts.
Figure 7:
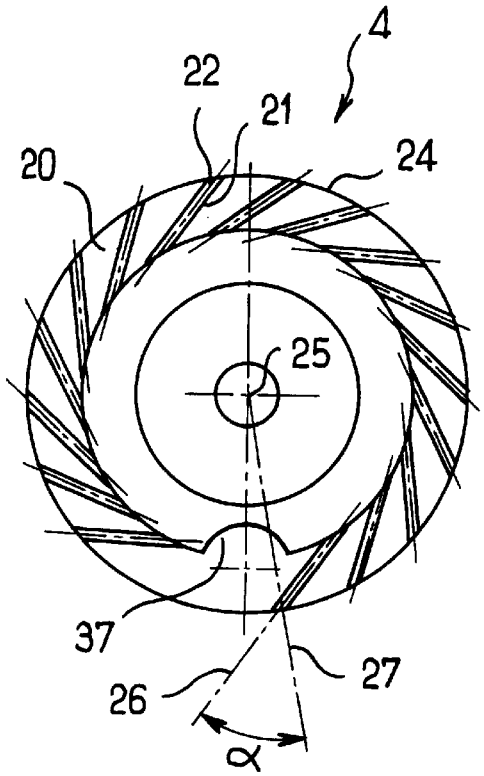

FIGS. 6 and 7 show, in plan view, bodies of burners with spiralling flames, which will be described where they differ from the body of the conventional burner 2 shown in FIG. 5.

In projection in the plane of view, the longitudinal directions 26 of the ducts 21, at their intersection with the peripheral line 24, all exhibit an inclination with respect to this line 24.

This inclination is indicated by an angle $\alpha$ formed between the said longitudinal directions 26 and the directions 27 normal to the said peripheral line 24 and passing through the flame outlet orifices 22.

The maximum power consumed by the burners with spiralling flames 4 of the appliance 1 according to the invention is greater than 3.5 kW (theoretical power calculated from the calorific power of the gas and the maximum gas flow rate in the burner).

For such power, the burner body 15 preferably has a diameter of between 70 and 80 mm, and contains for example eighteen ducts 21.

In order to be able to operate under satisfactory conditions, without penalising the secondary aeration, the gas burner with spiralling flames 4 has an angle $\alpha$ less than 40°.

In order to be able to satisfy the fabric ignition tests and to guarantee that flames do not protrude from under a standardized vessel of about 23 cm diameter, the burner with spiralling flames 4 according to the invention has an angle $\alpha$ greater than 20°.

According to the invention, the angle $\alpha$ is preferably between 20° and 40°.

FIG. 6 shows a burner 4 characterized by an angle substantially equal to 20°. Taking account of an outer diameter of the burner 4 of the order of 78 mm, the projected length of the flames 8 is reduced by about 10% in comparison with a burner with radial flames 2 of the same outer diameter and which would have the same power.

FIG. 7 shows a burner 4 characterized by an angle substantially equal to 40°. Taking account of an outer diameter of the burner 4 of the order of 78 mm, the projected length of the flames 8 is reduced by about 28% in comparison with a burner with radial flames 2 of the same outer diameter and which would have the same power.

The flame distributor ring 20, and in general the burner body 15, are made of metal, for example such as cast aluminium.

The shape of the delivery ducts 21 is designed such that it is possible to remove the flame distributor ring 20 from the mould while avoiding the formation of undesirable burrs in the ducts 21 and the orifices 22.

According to the invention, the inner and outer ends of the ducts 21 have a partially flared shape. More particularly, in projection in a middle plane perpendicular to the axis 25 of the burner 4, each block of material 30 separated by two consecutive ducts 210, 211, substantially has the shape of a quadrilateral, which has two opposite acute angles 31 and two obtuse angles 32, each acute angle 31 being adjacent to an obtuse angle 32, and the flaring is produced by the rounding of the acute angles 31.

One of the features of the invention consists in selecting the number, the position and the orientation of the burners with spiralling flames 4 on the hob 3 of the cooking appliance 1 for an optimum usage of the said appliance 1.

When the cooking appliance 1 comprises only one burner with spiralling flames 4, the latter is positioned at the front of the appliance 1.

A first embodiment (see FIG. 1) relates to a cooking appliance 1 comprising a single burner with spiralling flames 4 positioned at the front right of the appliance 1, and whose flames 8 wind around the burner 4 in the clockwise direction when the cooking hob 3 is seen from above.

This direction of winding of the flames 8 is obtained by delivery ducts 21 whose longitudinal direction 26, at its intersection with the distributor ring 20, exhibits an inclination to the right when the said peripheral line 24 is seen from the center of the burner 25.

With this orientation, the flames of the burner 4 which are on the side facing the other burner 2 located at the front are inclined towards the rear (FIG. 1) of the cooking hob 3. Thus the convection currents pass between the two cooking devices (40) located at the front of the cooking hob (3) turning in the same direction as the flames 8 around the burner 4 and thus increasing the inclination of the flames 8, which reduces their radial spread.

Thus the performance of the appliance 1 is increased. Furthermore, the disadvantages caused by excessive heat released toward the exterior and towards the front of the cooking hob 3 in the direction of the user, and into the critical zone located between the two front burners, are reduced.

Figure 9:
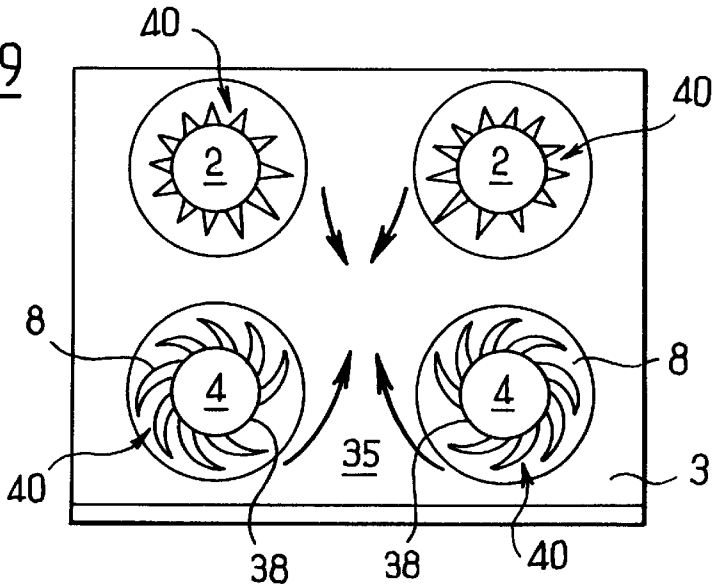
FIGS. 9 and 10 show, in plan view, two other embodiments of the cooking appliance according to the invention, and illustrate the method of mounting burners according to the invention on the cooking appliance according to the invention.

A second embodiment (not shown) provides a cooking appliance 1 comprising a single burner with spiralling flames 4 positioned at the front left of the appliance 1, and whose flames wind around the burner 4 in the anticlockwise direction (See FIG. 9, flame 8).

This direction of winding of the flames 8 is this time obtained by inclining the longitudinal directions 26 of the delivery ducts 21 to the left.

A third embodiment (see FIG. 9) relates to a cooking appliance 1 comprising two burners with spiralling flames, positioned at the front of the appliance 1.

For the reasons mentioned before, it is advantageous for the flames 8 of the burner 4 positioned at the front right to wind around that burner in the clockwise direction, and for the flames 8 of the burner 4 positioned at the front left to wind around in the anticlockwise direction.

This is obtained by inclining the longitudinal directions 26 of the delivery ducts 21 towards the right when the peripheral line is seen from the center 25 for the front right burner, and respectively toward the left for the front left burner.

It is therefore advantageous for the two burners with spiralling flames 4 to be of the same power, for example a power greater than 3.5 kW. In FIG. 9, the arrows indicate the convection movements induced by such burners 4.

A fourth embodiment (see FIG. 10) relates to a cooking appliance 1 comprising two burners with spiralling flames 4 both positioned on the front of the appliance 1, close to one another, that is to say separated by a space 35, and whose flames 8 wind around in the same direction for both burners.

It is possible to use two burners with spiralling flames 4 having the same power.

It is however advantageous for the most powerful burner with spiralling flames to be the one in which the longitudinal directions 26 of the ducts 21 are directed towards the rear of the appliance 1 in the space 35 between the two front burners.

Figure 10:
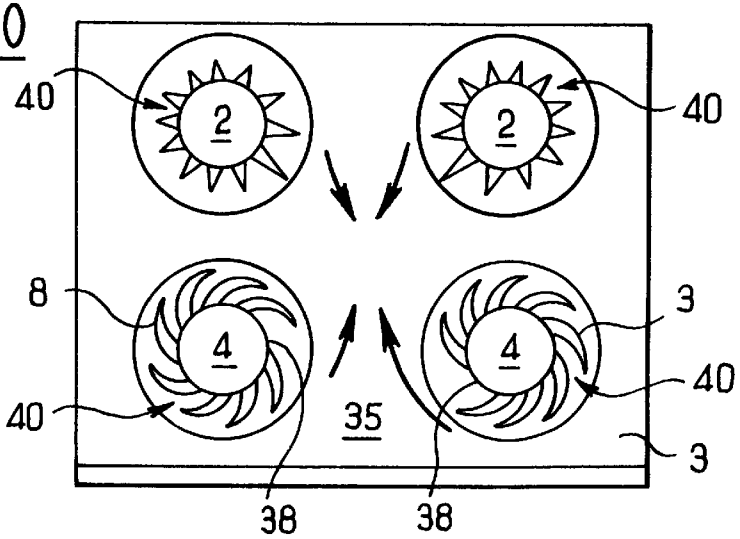

This will be the right burner when the direction of winding of the flames 8 is the clockwise direction (see FIG. 10). In effect, in the space 35, the flames of the burner 4 positioned at the front left tend to be straightened by the convection currents and this gives these flames a wider radial spread for a given power.

When the direction of winding of the flames is the anticlockwise direction (not shown), the most powerful burner is the left burner.

Preferably, the most powerful burner has a maximum power greater than 3.5 kW and the other burner has a maximum power of less than 3.5 kW.

As shown in FIGS. 6 and 7, the flame distributor ring 20 has on its outer surface a recess 37 for an accessory of the burner, such as for example a spark ignition device or a safety thermocouple.

The presence of the recess 37 interrupts the regularity of the distribution of ducts 21 by increasing the length of the interval defined between the said ducts.

When the burner with spiralling flames 4 is in operation, as shown in FIG. 1, the flames 8 coming from the two ducts 21 directly adjacent to the recess 37 are separated by a distance greater than that separating all of the other pairs of adjacent flames.

In operation, the burner with spiralling flames 4 thus comprises a zone 38 with an at least attenuated, if not eliminated, flame which corresponds to the recess 37.

On the cooking hob 3, the zone 38 exhibiting a local attenuation of the flame in service is facing towards another cooking device 40 which is also situated at the front of the appliance.

In other words, when the burner with spiralling flames 4 is mounted on the cooking hob 3, said burner 4 is positioned such that the recess 37 for an accessory of the burner is located on the side facing said other cooking device 40.

This orientation of the burner with spiralling flames 4 on the cooking hob 3 has the advantage that the flame zone 38 which is at least attenuated is thus oriented towards the part of the appliance where the presence of a user's sleeve is most probable and most dangerous. The risks of igniting fabrics are thereby reduced.

When two burners with spiralling flames 4 are mounted on the cooking hob 3, separated by a space 35, as shown in FIGS. 9 and 10, they are preferably positioned such that the flame zone 38 which is at least attenuated of each of them is facing the space 35.

The invention is not of course limited to the examples which have just been described, and numerous variations can be applied to these examples without departing from the scope of the invention.

In the same way it would be possible to envision cooking appliances 1 comprising more than four cooking devices 40. Said cooking devices 40 are not limited to gas burners, but may for example include electric hotplates.

The gas burners according to the invention may have contours other than a circular contour.

The gas mixture delivery ducts 21 can have, in projection in a plane perpendicular to the axis of the burner, a curved longitudinal direction. These ducts can be directed parallel to the plane perpendicular to the axis of the burner, or can have an angular deviation with respect to this plane, upwards or downwards. These ducts can have a circular cross-section or can have any other geometry.

What is claimed is:

1. A cooking appliance, comprising: several cooking devices distributed over a cooking hob, the cooking devices including, at the front of the appliance, two front cooking devices separated by a space and at least one of which is a gas burner including in particular a burner head, and having flame outlet orifices distributed around a peripheral line of a flame distributor ring forming part of the burner head, said orifices constituting the outside end of fuel mixture delivery ducts formed in the ring, said appliance further having:

in orthogonal projection in a mean plane perpendicular to the axis of said at least one of said front burners, the longitudinal directions of the ducts at their intersection with the peripheral line all exhibit an inclination to the same side with respect to this line such that the burner is a burner with flames spiralling about the axis of the burner, the inclination is such that in each said burner generating the spiralling flames, the flames adjacent to the said space separating said two front burners are inclined towards the rear of the appliance such that when at least said two front burners are ignited, the flames are reinforced by convection currents passing between said front burners in the same direction as the flames.

2. The appliance according to claim 1, characterized in that the most powerful gas burner is said burner with spiralling flames.

3. The appliance according to claim 1, further including at least one burner with substantially radial flames, of lower power.

4. The appliance according to claim 1, characterized in that the burner with spiralling flames has a power greater than 3.5 kW.

5. The appliance according to claim 1, characterized in that said burner with spiralling flames is the only burner with spiralling flames of the appliance.

6. The appliance according to claim 1, characterized in that the two front cooking devices are burners with spiralling flames for each of which the flames adjacent to the space are inclined towards the rear of the appliance.

7. The appliance according to claim 1, characterized in that the second front cooking device is a second burner with spiralling flames, whose flames adjacent to said space are inclined towards the front of the appliance and which is less powerful than the first burner with spiralling flames.

8. The appliance according to claim 1, characterized in that the second front cooking device is a second gas burner with radial flames.

9. The appliance according to claim 7, characterized in that the second gas burner has a power of less than 3.5 kW.

10. The appliance according to claim 1, characterized in that at least one said burner with spiralling flames comprises a flame zone which is at least attenuated on the side facing said space.

11. The appliance according to claim 10, characterized in that the flame zone which is at least attenuated corresponds to a recess for an accessory, located between two of the delivery ducts on the flame distributor ring, and whose presence interrupts the regularity of distribution of the ducts by increasing the distance between said two ducts.

12. A gas burner for an appliance according to claim 1, characterized in that the angle of said inclination is less than 40°.

13. The gas burner according to claim 12, characterized in that the angle of said inclination is greater than 20°.

14. The gas burner according to claim 12, characterized in that each block of material separating two consecutive ducts is projected, in a mean plane perpendicular to the axis of the burner, substantially as a quadrilateral having two opposite acute angles and two obtuse angles, each acute angle being adjacent to an obtuse angle and in that said acute angles are rounded.

15. The burner according to claim 12, characterized in that its maximum power is greater than 3.5 kW.

16. A method for mounting a gas burner with spiralling flames on a cooking hob designed for at least two cooking devices at the front and for at least one at the rear, comprising placing the burner with spiralling flames at the front of the cooking hob and on a side such that the flames adjacent to the other cooking device located at the front of the cooking hob are inclined towards the rear of the cooking hob.

17. The method according to claim 16, further comprising positioning the burner with spiralling flames such that a recess for an accessory of the burner, which causes a local flame attenuation in service, is located on the side facing said other cooking device.

18. A cooking appliance comprising:

several cooking devices distributed over a cooking hob, the cooking devices including, at the front of the appliance, two front cooking devices separated by a space and at least one of which is a gas burner including in particular a burner head, and having flame outlet orifices distributed around a peripheral line of a flame distributor ring forming part of the burner head, said orifices constitution the outside end of fuel mixture delivery ducts formed in the ring, said appliance further having:

in orthogonal projection in a mean plane perpendicular to the axis of the burner, the longitudinal directions of the ducts, at their intersection with the peripheral line, all exhibit an inclination to the same side with respect to this line, such that the burner is a burner with flames spiralling about the axis of the burner;

the inclination being such that the flames adjacent to the said space are inclined toward the rear of the appliance; and at least one said burner with spiralling flames comprises a flame zone which is at least attenuated on the side facing said space.

19. The appliance according to claim 18, characterized in that the flame zone which is at least attenuated corresponds to a recess for an accessory, located between two of the delivery ducts on the flame distributor ring, and whose presence interrupts the regularity of distribution of the ducts by increasing the distance between said two ducts.

20. A gas burner for a cooking appliance comprising several cooking devices distributed over a cooking hob, the cooking devices including, at the front of the appliance, two front cooking devices separated by a space and at least one of which is a gas burner including in particular a burner head, and having flame outlet orifices distributed around a peripheral line of a flame distributor ring forming part of the burner head, said orifices constituting the outside end of fuel mixture delivery ducts formed in the ring, said appliance further having:

in orthogonal projection in a mean plane perpendicular to the axis of the burner, the longitudinal directions of the ducts, at their intersection with the peripheral line, all exhibit an inclination to the same side with respect to this line, such that the burner is a burner with flames spiralling about the axis of the burner;

the inclination being such that the flames adjacent to the said space are inclined toward the rear of the appliance;

the angle of said inclination being less than 40°; and each block of material separating two consecutive ducts being projected, in a mean plane perpendicular to the axis of the burner, substantially as a quadrilateral having two opposite acute angles and two obtuse angles, each acute angle being adjacent to an obtuse angle and said acute angles being rounded.

21. A method for mounting a gas burner with spiralling flames on a cooking hob designed for at least two cooking devices at the front and for at least one at the rear, comprising placing the burner with spiralling flames at the front of the cooking hob and on a side such that the flames adjacent to the other cooking device located at the front of the cooking hob are inclined towards the rear of the cooking hob, and such that a recess for an accessory of the burner, which causes a local flame attenuation in service, is located on the side facing said other cooking device.

* * * * *